US007877045B2

(12) United States Patent
Hori

(10) Patent No.: US 7,877,045 B2
(45) Date of Patent: Jan. 25, 2011

(54) CHARGING DEVICE AND IMAGE FORMING APPARATUS

(75) Inventor: Takashi Hori, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 86 days.

(21) Appl. No.: 12/427,896

(22) Filed: Apr. 22, 2009

(65) Prior Publication Data

US 2009/0263160 A1 Oct. 22, 2009

(30) Foreign Application Priority Data

Apr. 22, 2008 (JP) ..... P2008-111875

(51) Int. Cl.
*G03G 15/02* (2006.01)

(52) U.S. Cl. ..... 399/171; 399/173

(58) Field of Classification Search ..... 399/168, 399/170–173

See application file for complete search history.

(56) References Cited

U.S. PATENT DOCUMENTS 7,302,211 B2 * 11/2007 Deguchi et al. ..... 399/171
7,567,771 B2 * 7/2009 Ino ..... 399/173
2007/0217822 A1 9/2007 Deguchi et al.

FOREIGN PATENT DOCUMENTS

| | | |
|---|---|---|
| JP | 11-040316 | 2/1999 |
| JP | 2006-113531 | 4/2006 |
| JP | 2007-256397 | 10/2007 |
| JP | 2008-090088 | 4/2008 |

* cited by examiner

*Primary Examiner*—Hoang Ngo
(74) *Attorney, Agent, or Firm*—Nixon & Vanderhye, P.C.

(57) ABSTRACT

There is provided a charging device having high durability, of which controllability of charged potential of a photoreceptor is hardly impaired even with a some amount of contaminants such as a toner so that control of charged potential of a photoreceptor can be stably carried out to fall in an appropriate range over a long period of time, and moreover which is inexpensive. As a grid electrode, one prepared by forming a composite plated layer composed of three layers of an Sn plated layer, an Sn—Co plated layer and a Ni plated layer is used. More preferably, an upper layer is an Sn plated layer, an intermediate layer is an Sn—Co plated layer and a lower layer is a Ni plated layer.

4 Claims, 5 Drawing Sheets

| | UNDER NORMAL TEMPERATURE/LOW HUMIDITY ENVIRONMENT | UNDER HIGH TEMPERATURE/HIGH HUMIDITY ENVIRONMENT |
|---|---|---|
| EXAMPLE1 |  |  |
| EXAMPLE2 |  |  |
| COMPARATIVE EXAMPLE1 |  |  |
| COMPARATIVE EXAMPLE2 |  |  |

CHARGING DEVICE AND IMAGE FORMING APPARATUS

CROSS-REFERENCE TO RELATED APPLICATION

This application claims priority to Japanese Patent Application No. 2008-111875, which was filed on Apr. 22, 2008, the contents of which are incorporated herein by reference in its entirety.

BACKGROUND OF THE INVENTION

1. Field of the Invention

The present invention relates to a noncontact charging device using a grid electrode, and to an image forming apparatus provided with the charging device.

2. Description of the Related Art

In electrophotographic image forming apparatuses such as copying machines, printers and facsimile units, images are formed as follows. By imparting electric charges to a surface of a photoreceptor on which surface a photosensitive layer is formed as an image nearing member and contains a photoconductive substance, the surface of the photoreceptor is uniformly charged. Subsequently, an electrostatic latent image corresponding to image information are formed in various image forming processes. The electrostatic latent image is developed by a toner-containing developer supplied from a developing section, so as to obtain a visible image which is then transferred onto a recording material such as paper. After that, the visible image is fixed on the recording material by heat and pressure given by a fixing roller so that an image is formed on a recording sheet. In the image forming apparatus as described above, a charging device is used for charging the surface of the photoreceptor. For example, the charging device includes: a charging wire (a discharging wire) that is an electrode for conducting corona discharge on the photoreceptor; a grid electrode which is an electrode disposed between the surface of the photoreceptor and the discharging electrode and to which appropriate voltage is applied, for controlling an amount of charges imparted from the charging wire to the surface of the photoreceptor, and thus carrying out control of charged potential of the surface of the photoreceptor; and a support member for supporting the charging wire and the grid electrode. As the grid electrode, for example, there are used a wire grid electrode made of stainless steel, tungsten or the like ingredient, and a porous plate-like grid electrode formed of a metal plate (grid substrate) of stainless steel or the like ingredient with a large number of perforations. Note that, upon manufacturing the porous plate-like grid electrode, etching or other methods can be adopted for making the perforations in the metal plate. The porous plate-like grid electrode manufactured by etching is referred to as an etching grid. Contaminants such as a toner are easily deposited on the wire grid electrode among the grid electrodes described above. Due to such deposition of the contaminants, the function for control of charged potential of the surface of the photoreceptor becomes insufficient, and this causes a problem to be solved that the potential of the charged surface of the photoreceptor is further uneven.

The charging device described in Japanese Unexamined Patent Publication JP-A 2006-113531 realizes a charging device that has high durability, generates no rust and the like, has the controllability of electrostatic charge potential that is hardly damaged even when some contaminants such as toner adhere to make it possible to stably control the electrostatic charge potential of a photoreceptor within a suitable range for a long period of time and is inexpensive, by forming a nickel plated layer including polytetrafluoroethylene particles on at least one surface of a substrate in a porous plate-like grid electrode.

The charging device described in JP-A 2007-256397 realizes a charging device that has high durability, generates no rust and the like, has the controllability of electrostatic charge potential that is hardly damaged even when some contaminants such as toner adhere to make it possible to stably control the electrostatic charge potential of a photoreceptor within a suitable range for a long period of time and is inexpensive, by forming a nickel layer including polytetrafluoroethylene on a part or the whole of the surface of a substrate and by setting the minor axis length of secondary agglomerates of polytetrafluoroethylene included in the nickel layer including polytetrafluoroethylene to be equal to or less than two times the thickness of the nickel layer including polytetrafluoroethylene in a porous plate-like grid electrode.

SUMMARY OF THE INVENTION

An object of the invention is to provide a charging device having high durability, of which controllability of charged potential of a photoreceptor is hardly impaired even with a some amount of contaminants such as a toner so that control of charged potential of a photoreceptor can be stably carried out to fall in an appropriate range over a long period of time, and moreover which is inexpensive, as well as an image forming apparatus including the charging device, which is capable of recording high-quality images over a long period of time.

The invention provides a charging device to be mounted in an electrophotographic image forming apparatus including a photoreceptor, so as to face a surface of the photoreceptor, comprising:

a charging electrode for charging the surface of the photoreceptor by applying a voltage to the charging electrode, and a grid electrode disposed between the charging electrode and the photoreceptor, including a porous plate-like substrate and a composite plated layer formed on a part or a whole of a surface of the porous plate-like substrate, wherein the composite plated layer is composed of three layers of an Sn plated layer, an Sn—Co plated layer and a Ni plated layer.

According to the invention, the charging device has a grid electrode, which includes a porous plate-like substrate and a composite plated layer composed of three layers of an Sn plated layer, an Sn—Co plated layer and a Ni plated layer formed on a part or a whole of a surface of the porous plate-like substrate.

This can realize a charging device that has high durability, has the controllability of electrostatic charge potential that is hardly damaged even when some contaminants such as toner adhere to make it possible to stably control the electrostatic charge potential of a photoreceptor within a suitable range for a long period of time and is inexpensive. Particularly, durability against such corrosion as rust in environments of high temperature and high humidity is further improved.

Furthermore, in the invention, it is preferable that the composite plated layer is constituted so that, when denoting a layer lying nearest to the surface of the porous plate-like substrate by a lower Layer, denoting a layer lying farthest from the surface of the porous plate-like substrate, which corresponds to the outermost layer, by an upper layer, and denoting a layer lying between the lower layer and the upper layer by an intermediate layer, the upper layer is an Sn plated layer, the intermediate layer is an Sn—Co plated layer, and the lower layer is a Ni plated layer.

According to the invention, the upper layer is an Sn plated layer, the intermediate layer is an Sn—Co plated layer, and the lower layer is a Ni plated layer. This results in a furthermore improved durability against such corrosion as rust in environments of high temperature and high humidity.

Furthermore, in the invention, it is preferable that the porous plate-like substrate is made of a porous stainless steel plate.

According to the invention, the use of a porous stainless steel plate causes very good controllability of electrostatic charge potential at the surface of a photoreceptor, and also a further improved durability against such corrosion as rust.

Furthermore, the invention provides an image forming apparatus comprising the charging device mentioned above.

According to the invention, by being provided with the charging device, an image forming apparatus capable of recording images having high image quality for a long period of time can be realized.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
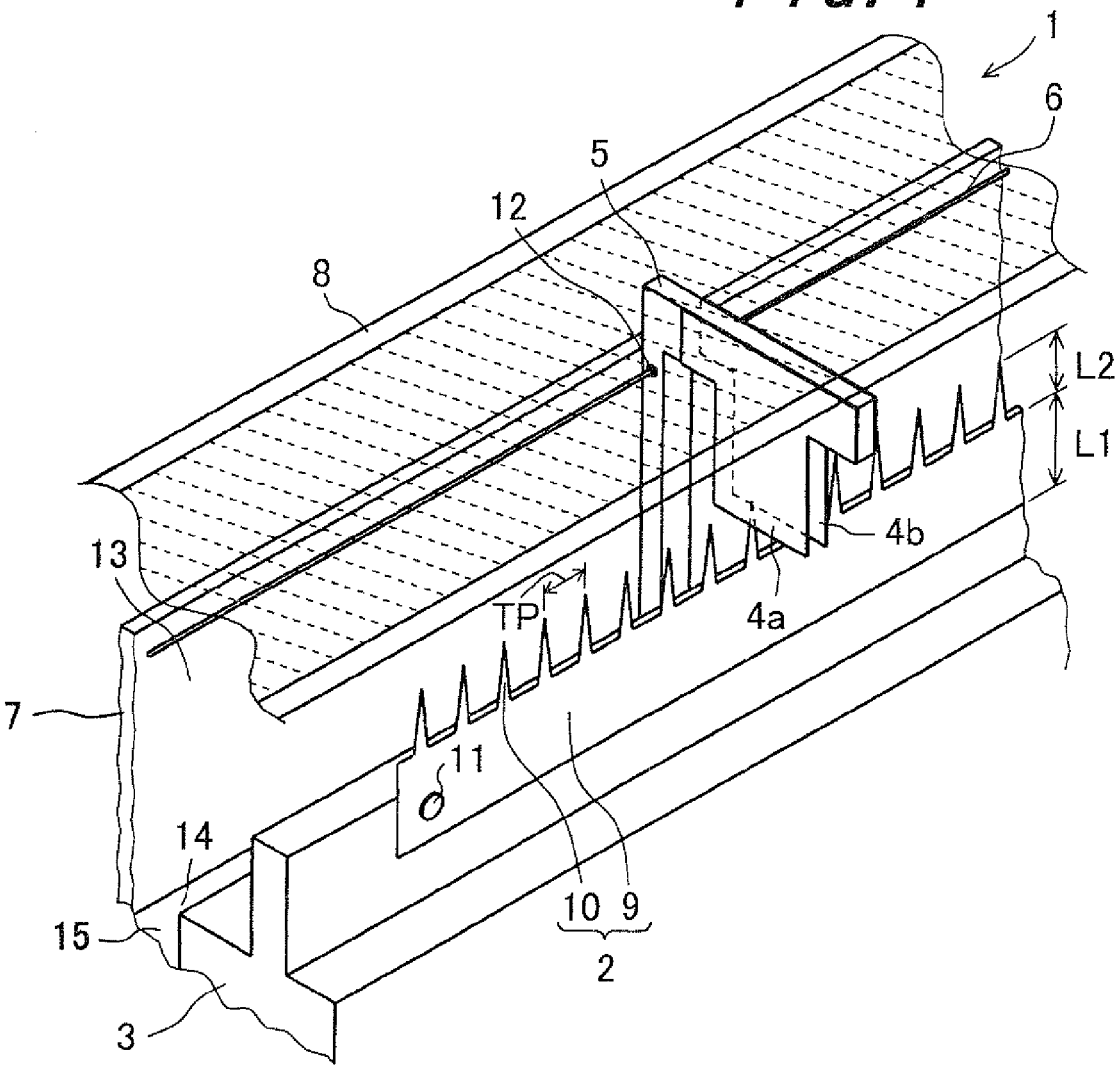
FIG. 1 is a perspective view schematically showing the constitution of a charging device according to a first embodiment of the invention.

Now referring to the drawings, preferred embodiments of the invention are described below.

Figure 2:
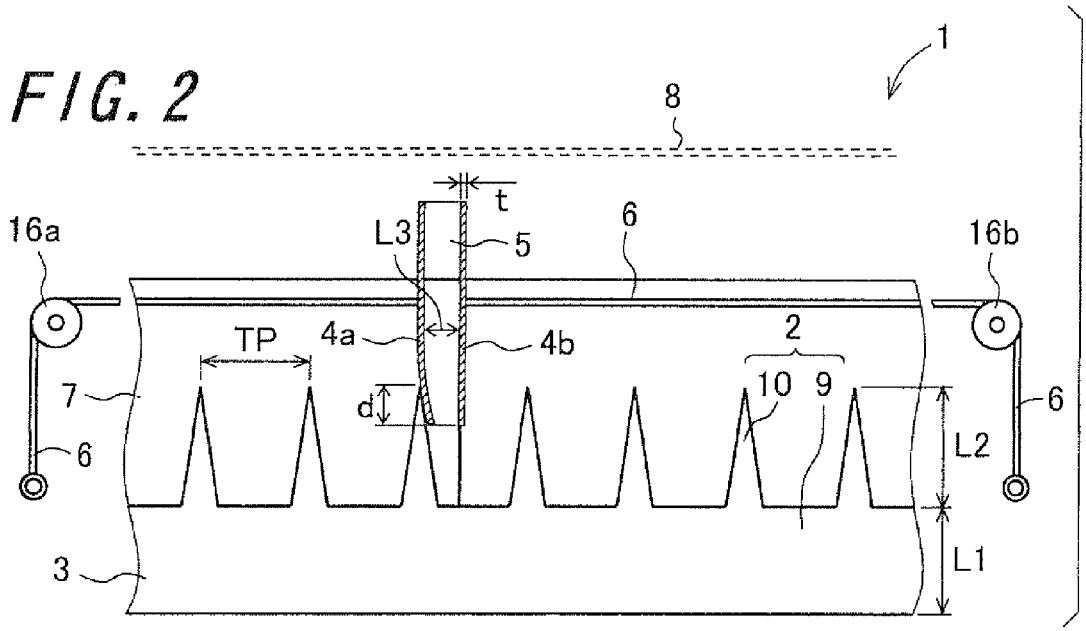
FIG. 2 is a front view of the charging device shown in FIG. 1.
Figure 3:
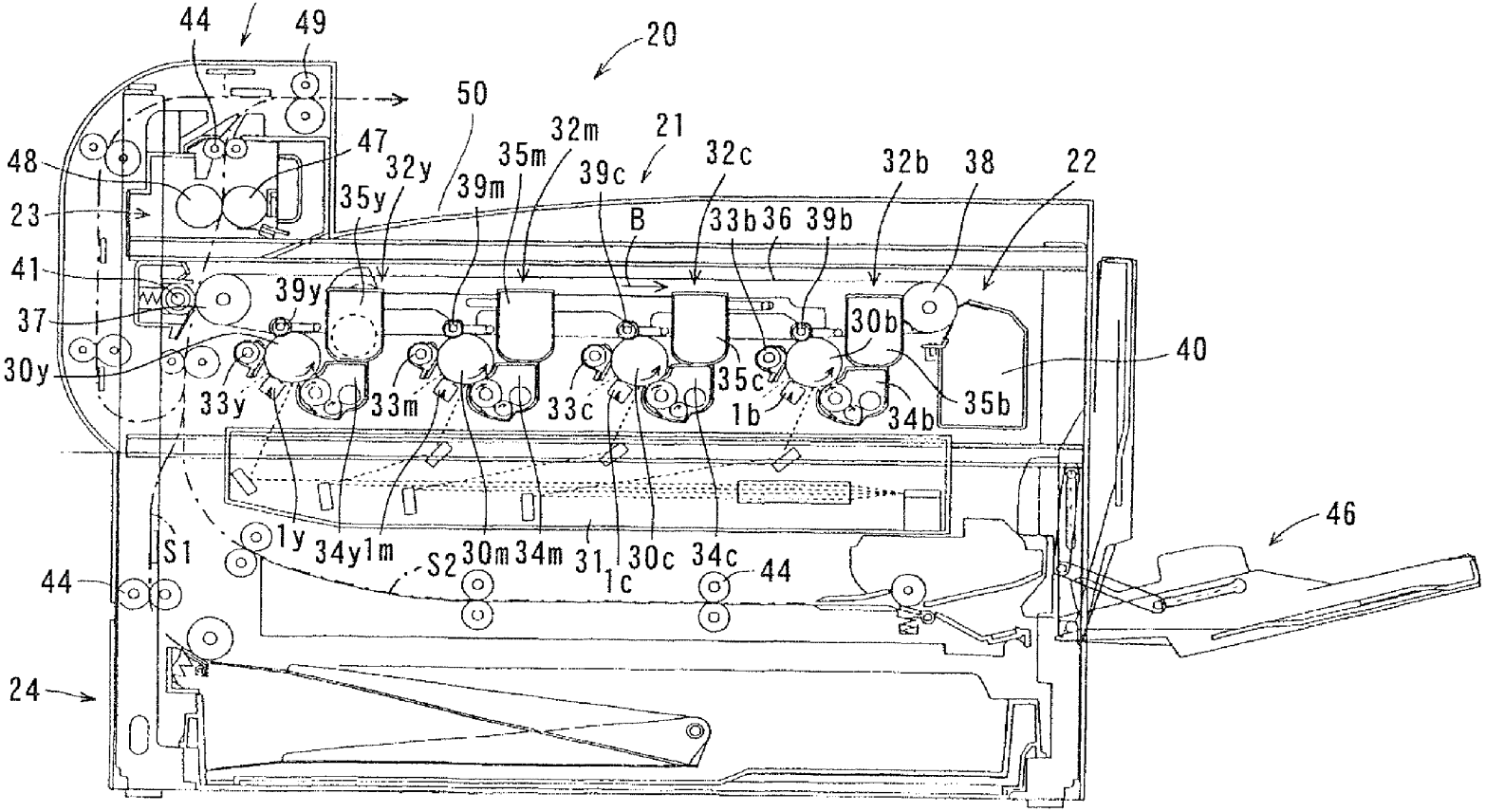
FIG. 3 is a cross-sectional view schematically showing the constitution of an image forming apparatus according to a second embodiment of the invention.

FIG. 1 is a perspective view schematically showing the constitution of a charging device 1 according to a first embodiment of the invention. FIG. 2 is a front view of the charging device shown in FIG. 1. FIG. 3 is a cross-sectional view schematically showing the constitution of an image forming apparatus 20 according to a second embodiment of the invention.

Initially, a whole image forming apparatus 20 provided with the charging device 1 will be explained. An image forming apparatus 20 is a multifunctional peripheral having a copier function, a printer function, and a facsimile function together, and according to image information being conveyed to the image forming apparatus 20, a full-color or monochrome image is formed on a recording medium such as a recording sheet. That is, the image forming apparatus 20 has three types of printer mode, i.e., a copier mode (duplicate mode), a printer mode and a facsimile mode, and the printer mode is selected by a control unit (not shown) depending on, for example, the operation input from an operation portion (not shown) and reception of the printing job from an external host apparatus such as a personal computer. The image forming apparatus 20 comprises a toner image forming section 21, a transfer section 22, a fixing section 23, a recording medium supply section 24, and a discharge section 25. In accordance with image information of respective colors of black (b), cyan (c), magenta (m), and yellow (y) which are contained in color image information, there are provided respectively four sets of the components constituting the toner image forming section 21 and a part of the components contained in the transfer section 22. The four sets of respective components provided for the respective colors are distinguished herein by giving alphabets indicating the respective colors to the end of the reference numerals, and in the case where the sets are collectively referred to, only the reference numerals are shown.

The toner image forming section 21 comprises a photoreceptor drum 30, a charging device 1, an exposure unit 31, a developing section 32, and a cleaning unit 33. The charging device 1, the developing section 32, and the cleaning unit 33 are disposed in this order around the photoreceptor drum 30. The charging device 1 is disposed vertically below the cleaning unit 33.

The photoreceptor drum 30 is rotatably supported around an axis thereof by a driving section (not shown), and includes a conductive substrate and a photosensitive layer formed on a surface of the conductive substrate, which are not shown. The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film obtained by forming a conductive layer containing one or two or more of aluminum, aluminum alloy, tin oxide, gold, indium oxide, etc. on a film-like substrate such as of synthetic resin film, metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. Provision of the undercoat layer offers advantages such as covering the flaws and irregularities present on the surface of the conductive substrate to thereby smooth the surface of the photosensitive layer, preventing degradation of the chargeability of the photosensitive layer during repetitive use, and enhancing the charging property of the photosensitive layer under a low temperature and/or low humidity circumstance.

The charge generating layer contains as a main ingredient a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generation ability and are suitable for obtaining a light sensitive layer at high sensitivity. The charge generating substances may be used each alone, or two or more of them may be used in combination. The content of the charge generating substance is, without a particular restriction, preferably from 5 to 500 parts by weight and more preferably from 10 to 200 parts by weight, based on 100 parts by weight of binder resin in the charge generating layer. Also as the binder resin for charge generating layer, materials used customarily in the relevant field can be used including, for example, melamine resin, epoxy resin, silicone resin, polyurethane, acryl resin, vinyl chloride-vinyl acetate copolymer resin, polycarbonate, phenoxy resin, polyvinyl butyral, polyallylate, polyamide, and polyester. The binder resins may be used each alone or, optionally, two or more of them may be used in combination. The charge generating layer can be formed by dissolving or dispersing an appropriate amount of a charge generating substance, binder resin and, optionally, a plasticizer, a sensitizer, etc. respectively in an appropriate organic solvent which is capable of dissolving or dispersing the ingredients described above, to thereby prepare a coating solution for charge generating layer, and then applying the coating solution for charge generating layer to the surface of a conductive substrate, followed by drying. The thickness of the charge generating layer obtained in this way is, without a particular restriction, preferably from 0.05 to 5 μm and more preferably from 0.1 to 2.5 μm.

The charge transporting layer stacked over the charge generating layer contains as an essential ingredient a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4 dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiopnene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, promanyl, chloranyl, and benzoquinone. The charge transporting substances may be used each alone, or two or more of them may be used in combination. The content of the charge transporting substance is, without a particular restriction, preferably from 10 to 300 parts by weight and more preferably from 30 to 150 parts by weight based on 100 parts by weight of the binder resin in the charge transporting substance. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resins thereof. Among those materials, in view of the film forming property, and the wear resistance, electrical characteristics etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resins may be used each alone, or two or more of them may be used in combination. The charge transporting layer preferably contains an antioxidant together with she charge transporting substance and the binder resin for charge transporting layer. Also for the antioxidant, materials used customarily in the relevant field can be used including, for example, Vitamin E, hydroquinone, hindered amine, hindered phenol, paraphenylene diamine, arylalkane and derivatives thereof, an organic sulfur compound, an organic phosphorus compound. The antioxidants may be used each alone, or two or more of them may be used in combination. The content of the antioxidant is, without a particular restriction, from 0.01 to 10% by weight and preferably from 0.05 to 5% by weight based on the total amount of the ingredients constituting the charge transporting layer. The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is, without a particular restriction, preferably from 10 to 50 μm and more preferably from 15 to 40 μm.

Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer. In the embodiment, as described above, there is used a photoreceptor drum which has an organic photosensitive layer using the charge generating substance and the charge transporting substance. It is, however, also possible to use, instead of the above photoreceptor drum, a photoreceptor drum which has an inorganic photosensitive layer using silicon or the like. The developing section 32 comprises a developing tank 34 and a toner hopper 35. The developing tank 34 is disposed so as to face the surface of the photoreceptor drum 30, and supplies toner to the electrostatic latent image formed on the surface of the photoreceptor drum 30, to develop the image so that a visible image, i.e., a toner image is formed. The transfer section 22 is arranged above the photoreceptor drum 30 and includes a transfer belt 36, a driving roller 37, a driven roller 38, intermediate transfer rollers 39 (*b, c, m, y*), a transfer belt-cleaning unit 40, and a transfer roller 41. The fixing section 23 is arranged on a downstream side of the transfer section 22 in a recording medium conveyance direction, and includes a heating roller 47 and a pressure roller 48, and further includes a heating source for the heating roller 47, a sensor for detecting the temperature of the heating roller 47, a control portion for controlling the operation of the heating source so that the heating roller 47 has a prescribed temperature, and the like. A recording medium-feeding portion 24 includes an automatic paper feed tray 42, a pickup roller 43, conveying rollers 44, registration rollers 45, and a manual paper feed tray 46. The discharge section 25 includes the conveying rollers 44, discharge rollers 49 and a catch tray 50.

The charging device 1 being used is the charging device 1 shown in FIGS. 1 and 2. The charging device 1 is disposed along a longitudinal direction of the photoreceptor drum 30 so that the charging device 1 faces the photoreceptor drum 30.

In the image forming section 21, the charging device 1 is disposed along a longitudinal direction of the photoreceptor drum 30 so as to face the photoreceptor drum 30. The charging device 1 includes: a plate electrode 2 that is a needle electrode having a plurality of pointed protrusions 10 (hereinafter referred to as "needle electrode 2"); a holding member 3; two cleaner members 4*a* and 4*b*; a support member 5; a moving member 6; a shield case 7; and a grid electrode 8. Note that, as well as the developing section 32, the cleaning unit 33, and the like component, the charging device 1 is disposed around the photoreceptor drum 30 while the charging device 1 is preferably disposed vertically below either or both of the developing section 32 and the cleaning unit 33 in the image forming apparatus 20 in order to reliably prevent the charging defects from occurring mainly on the photoreceptor drum 30. In the present embodiment, the charging device 1 is disposed vertically below the cleaning unit 33.

The needle electrode 2 is a thin plate member composed of a flat plate portion 9 and the pointed protrusions 10. The flat plate portion 9 is formed so as to extend long in one direction. The pointed protrusion 10 is formed so as to transversely protrude from one end face in a transverse direction of the flat plate portion 9. The needle electrode 2 is made of, for example, stainless steel. In the embodiment, a length L1 in the transverse direction of the flat plate portion 9 is 10 mm while a length L2 in the protruding direction of the pointed protrusion 10 is 2 mm, a radius of curvature R at a top of the pointed protrusion 10 is 40 μm, and a pitch TP at which the protrusions 10 are formed is 2 mm. To the needle electrode 2 is connected a power source (not shown). Voltage application from the power source to the needle electrode 2 causes the pointed protrusion 10 to conduct the corona discharge toward the surface of the photoreceptor drum 30 so that the surface of the photoreceptor drum 30 is charged. In the embodiment, a voltage of 5 kV is applied to the needle electrode 2.

The holding member 3 is a member which extends long in one direction like the needle electrode 2, and of which cross section in perpendicular to the longitudinal direction has an inverted T shape. The holding member 3 holds the needle electrode 2. The holding member 3 is formed of synthetic resin, for example. The needle electrode 2 is screwed by thread members 11 at near both ends in the longitudinal direction of the needle electrode 2 onto one lateral side of a protruded portion of the holding member 3.

The cleaner members 4*a* and 4*b* are platy members which are movable relative to the needle electrode 2 and upon moving, frictionally rubs the needle electrode 2 to thereby clean the surface of the needle electrode 2. In more detail, each of the cleaner members 4*a* and 4*b* has a T-shaped configuration when projected on a plane, and is made of an elastic body of a metal material or a polymeric material with a thickness t of from 20 to 40 μm. In the case where the thickness t is less than 20 μm, the member is easily deformed upon abutting against the needle electrode 2, but a reaction force accompanied by the deformation, i.e., the pressing force to the needle electrode 2, is small, with the result that contaminants deposited on the needle electrode 2 cannot be removed sufficiently. In the case where the thickness t exceeds 40 μm, the contaminants deposited on the needle electrode 2 can be removed sufficiently, but higher stiffness excessively increases the pressing force to the needle electrode 2, with the result that the tip of the pointed protrusion 10 of the needle electrode 2 may possibly be caused.

As the metal material constituting the cleaner members 4*a* and 4*b*, phosphor bronze, ordinary steel, stainless steel, etc. can be used. Among these metal materials, stainless steel is preferred from a viewpoint of the duration life based on anti-oxidation property while considering that the cleaner members 4*a* and 4*b* are used in the atmosphere of ozone generated by corona discharge. As stainless steel, heretofore known stainless steel can be used including, for example, austenitic stainless steel, i.e. SUS304 and ferritic stainless steel, i.e. SUS430, which are defined by Japanese Industrial Standard (JIS) G4305. The cleaner members 4*a* and 4*b* are disposed so as to have a gap L3 therebetween when viewed in their moving direction relative to the needle electrode 2. The gap L3 is selected to have a distance such that when one cleaner member 4*a* is deformed upon abutting against the needle electrode 2, the other cleaner member 4*b* is not in contact with the deformed member 4*a*, and this is adjustable by the thickness of the beam portion of the support member 5 to which the cleaner members 4*a* and 4*b* are attached. Since a deformation state of the cleaner members 4*a* and 4*b* changes depending on the material thereof, the gap L3 is preferably determined by a previous testing of the deformation state of the material. In the case where each of the cleaner members 4*a* and 4*b* is made, for example, of stainless steel at a thickness t of 30 μm, the gap L3 is preferably 2 mm. By virtue of the gap L3 provided between the two cleaner members 4*a* and 4*b*, while one cleaner member 4*a* frictionally rubs the needle electrode 2, the other cleaner member 4*b* does not hinder the deformation of one cleaner member 4*a* so that the pressing force is maintained within a preferred range. As a result, the needle electrode 2 can be cleaned sufficiently without causing deformation damage on the top end thereof.

The hardness of the cleaner member 4*a* and 4*b* is preferably 115 or more by Rockwell hardness M scale according to American Society for Testing and Materials (ASTM) Standards D785. In the case where the Rockwell hardness is less than 115, the material is excessively soft and therefore, the cleaner members 4*a* and 4*b* are deformed excessively than required when abutting on and frictionally rubbing the needle electrode 2, thus failing to obtain the cleaning effect. Since the high hardness of the cleaner members 4*a* and 4*b* causes no particular problem in function thereof, it is not necessary to define the upper limit. However, the upper limit, if defined, is 130 since the upper limit value in the Rockwell hardness M scale is 130. A lateral size w of the longitudinal rod portion of the T-shape of the cleaner members 4*a* and 4*b*, which is a portion abutting against the needle electrode 2, that is to say, the size w of the cleaner members 4*a* and 4*b* in the direction vertical to the moving direction of the cleaner members 4*a* and 4*b* and in the direction vertical to the extending direction of the pointed protrusion 10, is preferably 3.5 mm or more. In the case where the lateral size w is smaller than 3.5 mm, the value of a force per unit area generated upon deformation when pressed by the needle electrode 2 is large, and it therefore becomes easier to cause fatigue fracture due to the repetitive deformation, resulting in decrease in length of the duration life. The value of the force per unit area described above can be decreased to extend the duration life against the repetitive deformation by making the lateral size w to 3.5 mm or more. However, the excessively increased width makes the stiffness too high and the size of the device too large, and it is therefore preferable to set the upper limit to about 10 mm. The cleaner members 4*a* and 4*b* and the needle electrode 2 are preferably arranged such that an intrusion amount d of the pointed protrusion 10 of the needle electrode 2 to the cleaner members 4*a* and 4*b* is from 0.2 to 0.8 mm. The intrusion amount d means an overlap length between the cleaner members 4*a* and 4*b* and the pointed protrusion 10 in the extending direction of the pointed protrusion 10 in a state where the cleaner members 4*a* and 4*b* and the pointed protrusion 10 are projected upon a virtual plane perpendicular to a moving direction of the cleaning members 4*a* and 4*b* relative to the needle electrode 2. In the case where the intrusion amount d is less than 0.2 mm, a reaction force accompanied by the deformation, i.e., the pressing force to the needle electrode 2, is small, with the result that contaminants deposited on the needle electrode 2 cannot be removed sufficiently. In the case where the intrusion amount d exceeds 0.8 mm, the contaminants deposited on the needle electrode 2 can be removed sufficiently, but the reaction force accompanied by the deformation (i.e. the pressing force to the needle electrode 2) is too large, with the result that the tip of the pointed protrusion 10 of the needle electrode 2 may possibly be fractured by the deformation. As a result, in the case where the intrusion amount d is out of the range from 0.2 to 0.8 mm, image unevenness etc. due to the charging defect may possibly be caused.

The support member 5 is a member having an inverted L-shaped configuration for supporting the cleaner members 4*a* and 4*b*. To a beam portion of the support members 5 are attached arm portions of the cleaner members 4*a* and 4*b* in the T-shaped configuration. The columnar portion of the support member 5 has a through hole 12 therein, which extends in parallel with the extending direction of the needle electrode 2 and through which the moving member 6 is inserted. Since the moving member 6 is fixed to the support member 5 at a portion where the moving member 6 is inserted through the through hole 12, traction of the moving member 6 in the extending direction of the needle electrode 2 makes the support member 5 move slidably with respect to the groove 14 so that the support member 5 is guided by the groove portion 14 to be thereby allowed to move in the extending direction of the needle electrode 2. That is to say, the cleaner members 4*a* and 4*b* supported by the support member 5 can be made to abut on and frictionally rub the needle electrode 2. The moving member 6 is a thread-like or wire-like member, which is inserted through the through hole 12 formed in the columnar portion of the support member 5 and thus provided in parallel with the extending direction of the needle electrode 2. The moving member 6 extends from a hole or gap formed in the later-described shield case 7 to outside of the shield case 7 so that an end of the moving member 6 is suspended by way of an outer surface of the shield case 7 or by way of pulleys 16*a* and 16*b* disposed on a machine body of the image forming apparatus 20. The pulleys 16*a* and 16*b* and the end of the moving member 6 are not shown in FIG. 1.

The end of the moving member 6 preferably extends as far as the outside of the machine body of the image forming apparatus 20. This enables to clean the needle electrode 2 without detaching the charging device 1 from the image forming apparatus 20 or without opening the image forming apparatus 20. When cleaning is conducted by making the cleaner members 4*a* and 4*b* abut on the needle electrode 2 by means of traction of the moving member 6, the pressing force of the cleaner members 4*a* and 4*b* against the needle electrode 2 is adjusted preferably to 10 to 30 gf. In the case where the pressing force is less than 10 gf, contaminants such as a toner or paper dust deposited on the needle electrode 2 cannot possibly be removed sufficiently and, on the other hand, in the case where the pressing force exceeds 30 gf, the top end of the pointed protrusion 10 of the needle electrode 2 may possibly be fractured by deformation. Further, the pressing force of the cleaner members 4*a* and 4*b* against the needle electrode 2 can be adjusted by the moving member 6. The force loaded on the cleaner member 4*a* or 4*b* is measured in a state where a weight is suspended from one end of the moving member 6. Measurement is conducted, for example, by connecting a spring balance to the cleaner member 4*a* or 4*b*. Then, by selecting a weight to provide a force of 10 to 30 gf loaded on the cleaner member 4*a* or 4*b* and suspending the pre-selected weight to the end of the moving member 6 upon cleaning the needle electrode 2, cleaning can be conducted under a predetermined pressing force. Alternatively, an electric motor of which a rotational torque has been adjusted may be connected to the end of the moving member 6 so that a predetermined pressing force can be loaded.

The shield case 7 is made of, for example, stainless steel. The shield case 7 is a container-like member of which outer shape is a rectangular parallelepiped with an inner space and which has an opening in one surface facing the above-described photoreceptor drum 30. In the internal space of the shield case 7 are housed at least the needle electrode 2, the holding member 3, the cleaner members 4*a* and 4*b*, and support member 5. Further, the shield case 7 extends long in the same direction as extending direction of the needle electrode 2. A cross sectional configuration of the shield case 7 in a direction perpendicular to a longitudinal direction thereof is substantially U-shaped. Further, a holding member 3 is attached to a bottom 15 of the shield case 7. Moreover, an end of a columnar portion of the support member 5 is inserted slidably into a groove 14 which is formed by an inner lateral surface 13 of the shield case 7 and the holding member 3.

The grid electrode 8 is located between the needle electrode 2 and the photoreceptor drum 30. When a voltage is applied to the grid electrode 8, the grid electrode adjusts unevenness in charges on the surface of the photoreceptor drum 30 so as to equalize the charged potential of the photoreceptor drum 30. The grid electrode 8 includes a porous plate-like substrate, and a composite plated layer formed on a part or a whole of the porous plate-like substrate. The porous plate-like substrate is formed of such a metal as stainless steel, aluminum, nickel, copper and iron.

The composite plated layer is composed of three layers of an Sn (tin) plated layer, an Sn—Co (tin-cobalt) plated layer, and a Ni (nickel) plated layer. When denoting a layer lying nearest to the surface of the porous plate-like substrate by a lower layer, denoting a layer lying farthest from the surface of the porous plate-like substrate, which corresponds to the outermost layer, by an upper layer, and denoting a layer lying between the lower layer and the upper layer by an intermediate layer, the constitutional order of respective layers is preferably such that the upper layer is an Sn (tin) plated layer, that the intermediate layer is an Sn—Co (tin-cobalt) plated layer, and that the lower layer is a Ni (nickel) plated layer.

These plated layers are formed by a publicly known method for forming a plated layer. They may be formed by an electroless plating or electrolytic plating.

The thickness of the Sn (tin) plated layer is from 10 to 15 μm. The thickness of the Sn—Co (tin-cobalt) plated layer is 0.15 μm. The thickness of the NI (nickel) plated layer is from 0.2 to 0.5 μm.

EXAMPLES

In both Examples and Comparative Examples, as the porous plate-like substrate, a porous stainless steel plate having a size of 14 mm in length, 375 mm in breadth and 0.1 mm in thickness was used. On the whole surface thereof, a plated layer was formed.

In Example 1, a composite plated layer composed of such three layers as the upper layer of an Sn (tin) plated layer (thickness: 5 μm), the intermediate layer of an Sn—Co (tin-cobalt) plated layer (thickness: 0.5 μm), and the lower layer of a Ni (nickel) plated layer (thickness: 0.5 μm) was formed on the porous plate-like substrate.

In Example 2, a composite plated layer composed of such three layers as the upper layer of an Sn—Co (tin-cobalt) plated layer (thickness: 0.5 μm), the intermediate layer of an Sn (tin) plated layer (thickness: 5 μm), and the lower layer of a Ni (nickel) plated layer (thickness: 0.5 μm) was formed on the porous plate-like substrate.

In Comparative Example 1, a composite plated layer composed of such two layers as the upper layer of a polytetrafluoroethylene (PTFE)-containing nickel plated layer (thickness: 3 μm) and the lower layer of a Ni plated layer (thickness: 0.5 μm) was formed on the surface of the porous plate-like substrate.

In Comparative Example 2, a composite plated layer composed of such three layers as the upper layer of an Sn—Co (tin-cobalt) plated layer (thickness: 0.5 μm), the intermediate layer of Au (gold) plated layer (thickness: 0.08 μm), and the lower layer of Ni (nickel) plated layer (thickness: 0.5 μm) was formed on the surface of the porous plate-like substrate.

Under a normal temperature/low humidity environment (NL) and a high temperature/high humidity environment (HH), the degradation of grid electrode surface, the degradation of images, and the variation of surface potential were evaluated.

Meanwhile, a condition in which environmental temperature was 25° C. and relative humidity was 5% was referred to as the normal temperature/low humidity environment (NL), and a condition in which environmental temperature was 35° C. and relative humidity was 85% was referred to as the high temperature/high humidity environment (HH).

(Degradation of Grid Electrode Surface)

Under the normal temperature/low humidity environment (NL) and the high temperature/high humidity environment (HH), 60-hour discharge was performed and the generation of rust on the surface of a grid electrode formed with a plated layer was checked using a microscope at a magnification of 500 times.

Figure 4:
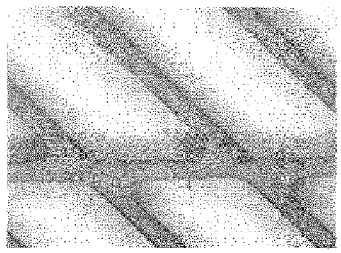
FIG. 4 is a drawing showing the result of the degradation of a grid electrode surface.
Figure 4:
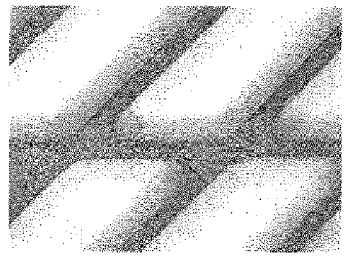
Figure 4:
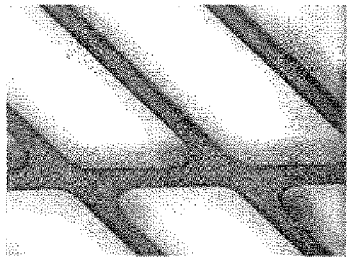
Figure 4:
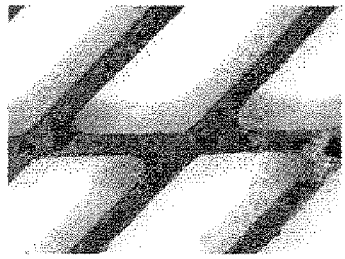
Figure 4:
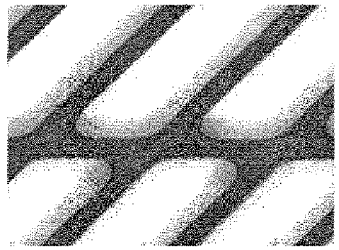
Figure 4:
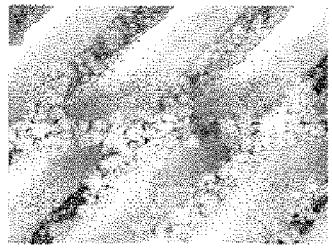
Figure 4:
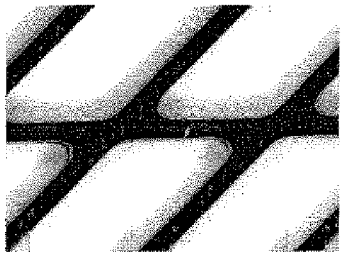
Figure 4:
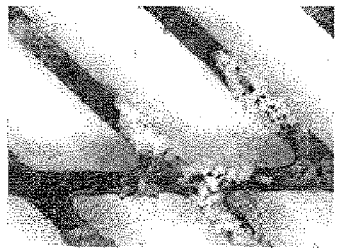

FIG. 4 is a drawing showing the result of the degradation of the grid electrode surface.

In Comparative Examples 1 and 2, no generation of rust was observed under the normal temperature/low humidity environment (NL), but the generation of a large amount of rust (oxide of nickel) was observed under the high temperature/high humidity environment (HH).

In Example 2, no generation of rust was confirmed under the normal temperature/low humidity environment (NL), but the generation of a very small amount of rust (oxide of nickel) was observed.

In Example 1, no generation of rust was confirmed under both normal temperature/low humidity environment (NL) and high temperature/high humidity environment (HH).

(Degradation of Image Quality)

For products in Examples 1 and 2, and Comparative Examples 1 and 2, 100-sheet continuous printing was performed by an actual machine under the normal temperature/low humidity environment (NL) and the high temperature/high humidity environment (HH) to visually check printed images. No degradation of image quality was observed for respective products in Examples 1 and 2, and Comparative Examples 1 and 2.

(Variation of Surface Potential)

For products in Examples 1 and 2, and Comparative Example 1, a grid bias voltage from 400 to 850 V was applied under the normal temperature/low humidity environment (NL) and the high temperature/high humidity environment (HH) to measure the difference from the surface potential of the photoreceptor as a potential variation [V].

Figure 5:
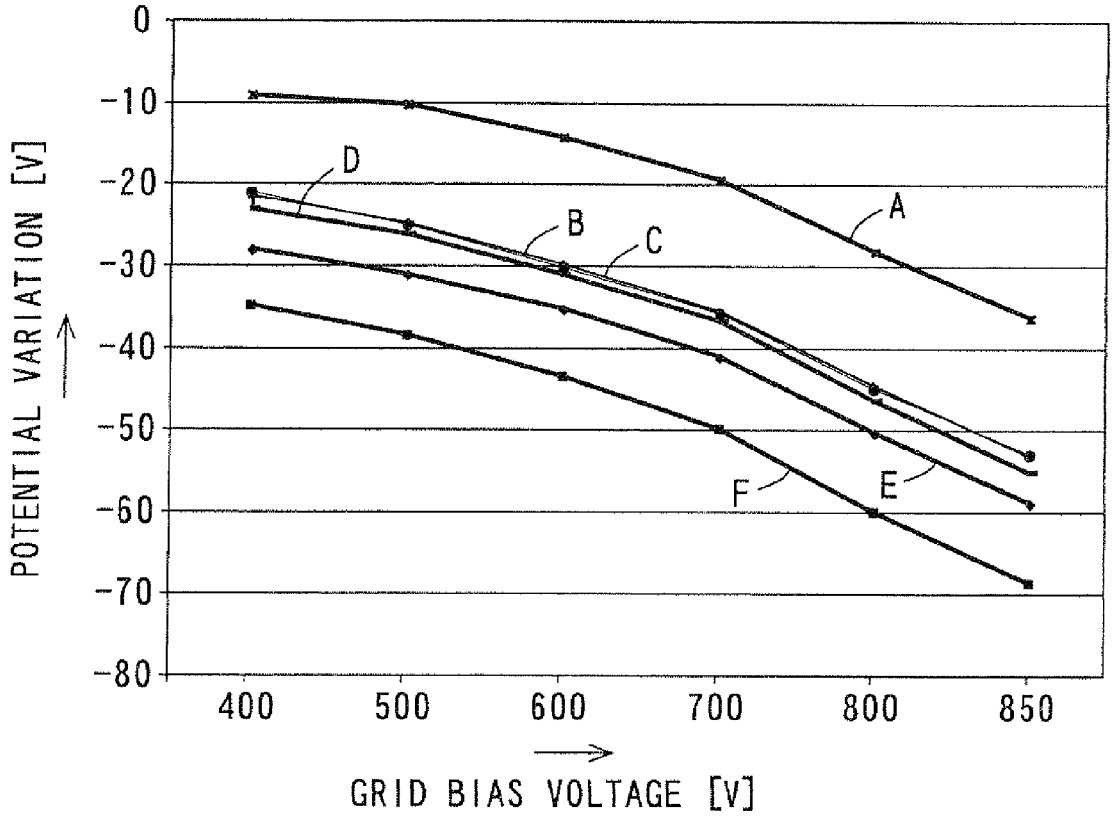
FIG. 5 is a graph showing the measurement result of a voltage variation.

FIG. 5 is a graph showing the measurement result of the voltage variation.

The horizontal axis represents grid bias voltage [V], and the vertical axis represents potential variation [V]. The potential variation is the difference between the grid bias voltage and the surface potential of the photoreceptor. Accordingly, it can be said that a smaller value means more excellent charging performance.

In the graph, the zigzag line A shows the result under the normal temperature/low humidity environment in Example 1, the zigzag line B shows the result under the high temperature/high humidity environment in Example 1, the zigzag line C shows the result under the normal temperature/low humidity environment in Example 2, the zigzag line D shows the result under the high temperature/high humidity environment in Example 2, the zigzag line E shows the result under the normal temperature/low humidity environment in Comparative Example 1, and the zigzag line F shows the result under the high temperature/high humidity environment in Comparative Example 1.

It was found that, in Examples 1 and 2, the potential variation is suppressed to a small value, and that, in Comparative Example 1, the variation is greater than that in Examples 1 and 2 even under the normal temperature/low humidity environment and is furthermore greater under the high temperature/high humidity environment.

From the above results, by forming the composite plated layer composed of three layers of the invention, generation of rust was suppressed, no degradation of image quality was observed, and the potential variation was suppressed to a small value.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A charging device to be mounted in an electrophotographic image forming apparatus including a photoreceptor, so as to face a surface of the photoreceptor, comprising:

a charging electrode for charging the surface of the photoreceptor by applying a voltage to the charging electrode, and a grid electrode disposed between the charging electrode and the photoreceptor, including a porous plate-like substrate and a composite plated layer formed on a part or a whole of a surface of the porous plate-like substrate, wherein the composite plated layer is composed of three layers of an Sn plated layer, an Sn—Co plated layer and a Ni plated layer.

2. The charging device of claim 1, wherein the composite plated layer is constituted so that, when denoting a layer lying nearest to the surface of the porous plate-like substrate by a lower layer, denoting a layer lying farthest from the surface of the porous plate-like substrate, which corresponds to the outermost layer, by an upper layer, and denoting a layer lying between the lower layer and the upper layer by an intermediate layer, the upper layer is an Sn plated layer, the intermediate layer is an Sn—Co plated layer, and the lower layer is a Ni plated layer.

3. The charging device of claim 1, wherein the porous plate-like substrate is made of a porous stainless steel plate.

4. An image forming apparatus comprising the charging device of claim 1.

* * * * *